United States Patent [19]

Inamorato et al.

[11] 3,931,034

[45] Jan. 6, 1976

[54] DETERGENT MATERIALS CONTAINING ENZYMES

[75] Inventors: Jack Thomas Inamorato, Westfield; Robert Tweedy Hunter, Jr., Mendham, both of N.J.

[73] Assignee: Colgate-Palmolive Company, New York, N.Y.

[22] Filed: Aug. 20, 1973

[21] Appl. No.: 389,762

Related U.S. Application Data

[63] Continuation of Ser. No. 200,629, Nov. 19, 1971, abandoned, which is a continuation of Ser. No. 733,279, May 31, 1968, abandoned.

[52] U.S. Cl. ..... 252/132; 252/89; 252/109; 252/110; 252/135; 252/524; 252/525; 252/527; 252/528; 252/529; 252/531; 252/532; 252/535; 252/536; 252/539; 252/542; 252/544; 252/545; 252/547; 252/548; 252/550; 252/551; 252/554; 252/558; 252/559; 252/DIG. 1; 252/DIG. 7; 252/DIG. 12

[51] Int. Cl.[2] ..... C11D 9/38; C11D 10/00

[58] Field of Search ..... 252/531, 532, 535, 539, 252/550, 551, 554, 558, 89, 132, DIG. 12, 109, 110, 135, 524, 527, 528, 529, 536, 542, 544, 545, 547, 548, 559, DIG. 1, DIG. 7

[56] References Cited

UNITED STATES PATENTS

| | | | |
|---|---|---|---|
| 3,451,935 | 6/1969 | Roald et al. | 252/135 |
| 3,630,930 | 12/1971 | Davis et al. | 252/531 |

FOREIGN PATENTS OR APPLICATIONS

| | | | |
|---|---|---|---|
| 14,296 | 1/1958 | Germany | 252/DIG. 12 |
| 6,715,387 | 5/1968 | Netherlands | |

OTHER PUBLICATIONS

"Maxatase," Royal Netherlands Fermentation Ind., Ltd., Delft-Holland, Apr. 1967, pp. 11–14.

*Primary Examiner*—Leland A. Sebastian
*Attorney, Agent, or Firm*—Robert L. Stone; Murray M. Grill; Herbert S. Sylvester

[57] ABSTRACT

A mixture of a non-cationic surface active detergent, a bacterial amylase of the alpha type, and an alkaline protease, which composition contains about 100,000 to 400,000 Novo alpha-amylase units of said amylase per Anson unit of said alkaline protease.

7 Claims, No Drawings

DETERGENT MATERIALS CONTAINING ENZYMES

This is a continuation of application Ser. No. 200,629 filed Nov. 19, 1971, now abandoned, which was a continuation of Ser. No. 733,279, filed May 31, 1968, now abandoned.

The preparation of detergent compositions containing enzymes for use in the washing of clothes is well known in the art. Best results have been obtained thus far by the use of proteolytic enzymes ("proteases"). The use of amylases has also been suggested but these have been found to be much less effective. The more effective proteolytic enzymes are quite expensive and their inclusion in detergent compositions results in a substantial increase in the cost of the composition.

In accordance with one aspect of this invention there is provided an enzyme-containing detergent composition comprising a mixture of a non-cationic surface active detergent, a bacterial amylase of the alpha type, and an alkaline protease, which composition contains about 100,000 to 400,000 Novo alpha-amylase units of said amylase per Anson unit of said alkaline protease. It is found, surprisingly, that by the use of an amount of alpha-amylase within this range the amount of the expensive protease needed to attain a given level of stain removal is greatly reduced, and the cost of the enzyme-containing detergent composition is lowered considerably although its effectiveness is retained.

One especially suitable alkaline protease for use in the practice of this invention is subtilopeptidase A, which is found in the enzyme preparation sold under the name "Alcalase", which has its greatest activity at pH 8–9.

The activity of the alkaline protease may be measured by an assay procedure in which the enzyme is used to digest a denatured haemoglobin substrate for 10 minutes at 25°C in a buffered aqueous medium at the selected pH and the amount of digested material is determined by a color test with phenol reagent, as in the measurement of the Anson unit activity, as described in Jour. Gen. Physiology Vol. 22 p. 79 (1939).

Another assay procedure (for the alkaline protease) involves the use of the known Hammersten type of casein as the substrate, the digestion of the substrate being carried out in buffered aqueous medium at a temperature of 50°C. for, say, 15 minutes in a glass tube. The enzyme is then inactivated, and the digestion is stopped, by plunging the glass tube into a boiling water bath. The extent of digestion is then measured by adding an aliquot of the digested solution to citrate buffer and a ninhydrin solution. Ninhydrin reacts with the amino groups freed during the original assay to form a blue color at high temperature. The darker the color the greater the digestion of casein by the enzyme. The intensity of color is measured (e.g. with a Spectronic "20" colorimeter). Since undigested casein in the solution also contributes to the color, the results for all samples must be compared to the results obtained on a blank containing only the casein and buffer, without the added enzyme. Further details of the assay procedure are given later in this application.

The alkaline protease used in the practice of this invention is found to be resistant to the effects of chelating agents such as trisodium ethylenediaminetetraacetate (EDTA), indicating that a metal cofactor is not involved in the activity of the enzyme. Thus, when the casein digestion test described above is modified by the inclusion of EDTA (in a concentration of about 0.01 M, based on total mixture being digested in the aqueous digestion medium) the activity of the alkaline protease is reduced by at most about 25%. In contrast the same inclusion of EDTA in a test of a neutral type of protease reduces the activity by some 75% or more, but the neutral protease can be reactivated, or prevented from losing its activity in the presence of EDTA by the action of certain metal ions (such as zinc), which indicates that a metal cofactor is required for its activity. The alkaline protease used in the practice of this invention is, however, substantially inactivated by conventional treatment with diisopropyl fluorophosphate (which is a standard reagent for combining with a serine unit of a protein), thus indicating that the active site of the enzyme has a serine unit; in this respect the alkaline protease used in this invention again differs from the common neutral protease which substantially retains its activity after it has been treated with the same diisopropyl fluorophosphate reagent. Using these, and other known distinctions (such as the known tests in which the activity is measured after treatments, as with cyanides, that destroy SH groups) one skilled in the art can readily determine the Anson activity attributable to the alkaline protease in a mixtue containing both alkaline and neutral proteases.

The alpha-amylase used in the practice of this invention may also be obtained by fermentation of B. subtilis. It may contain other enzymes in admixture with the amylase (e.g. some neutral protease). The amylase assay, in Novo units, may be found by a well known standard procedure which is a modification of the SKB method (Sandstedt, Kneen & Blish, Cereal Chemistry 16, 712, (1939)) without addition of beta-amylase. In this procedure 20 ml of a buffered starch solution are measured in a test tube (diameter 24 mm, length 190 mm) and placed in a water thermostat at a temperature of 37°C. After a few minutes pre-warming, 10 ml of the amylase solution to be tested (or v ml amylase solution + (10-v) ml water) is added. The contents of the tube are thoroughly mixed and at the same time a stopwatch is started. At appropriate time intervals 1 ml of the reaction mixture is added to 5 ml of a dilute iodine solution, shaken and transferred to a comparison tube, and the colour is compared with the standard colour. If the colour endpoint is reached in less than 10 minutes, a more dilute amylase solution or a smaller volume of amylase solution is used.

As colorimeter the Hellige Comparator 607 is used with the glass alpha-amylase standard. (cf. Redfern Methods for determination of alpha-amylase, Cereal Chemistry 24, 259, (1947)). The alpha-amylase activity of the sample may be calculated by using the following formula:

$$A = \frac{1430 \times V}{t \times a \times v}$$

where

A = alpha-amylase activity in Novo Units per gram
t = time to reach the colour endpoint
a = weight of sample in grams
V = volume to which the sample is diluted (ml)
v = volume of amylase solution used (ml)

The factor "1430" is not strictly constant but depends to some degree upon the starch quality used. For exact determinations, the value of the factor should be calculated by means of a commercially available standard amylase preparation with known activity. The dilute iodine solution mentioned above is prepared by dissolving 1 ml of "stock iodine solution" and 20 g of potassium iodide in sufficient water to make 500 ml; the "stock iodine solution" is prepared by dissolving 11 g of iodine crystals and 22 g of potassium iodide in sufficient water to make 500 ml. The buffered starch solution mentioned above is prepared as follows: 10 g soluble starch (e.g. Merck. Amylum solubile, Soluble Starch, Erg. B.6) calculated as dry matter are made into a slurry with some water. The slurry is added to about 200 ml of boiling water. When the starch is completely dissolved, the solution is cooled, transferred to a 1 liter volumetric flask and made up to the mark with water. The starch solution is mixed with 390 ml water and 50 ml of a buffer-salt solution (made by dissolving 9.36 g NaCl, 69.00 g $KH_2PO_4$, 4.80 g $Na_2HPO_4$, 2 $H_2O$ in sufficient water to make 1 liter). Finally the solution is saturated with toluene. The pH of the finished buffered starch solution should be 5.7. The starch solution must be as freshly prepared as possible but can be stored in the refrigerator for not more than 24 hours. Distilled water is used in all cases.

One particularly suitable source of alpha-amylase is the endoamylase preparation sold as Novo amylase which contains about 360,000 Novo amylase units and 0.4 – 0.5 Anson unit of neutral protease per gram. Another suitable source, which is substantially free of protease, is Wallerstein Amylase.

The amount of the enzyme mixture present in the detergent composition will, of course, depend to some extent on the amount of the detergent composition which is to be added to the wash water. For detergent compositions which are intended for use at concentrations of, say, about 0.15% in the wash water of an automatic home laundry machine, one suitable amount of enzyme mixture is such as to provide 1 Anson unit of the alkaline protease for each 100 to 500 (e.g. 200 to 400) grams of the detergent composition.

The mixture preferably contains an anionic surface active detergent, most preferably a sulfonated detergent, such as an alkylbenzenesulfonate. Nonionic surface active detergents or amphoteric surface active detergents may also be present, alone or together with the anionic detergent.

The anionic surface active agents include those surface active or detergent compounds which contain an organic hydrophobic group and an anionic solubilizing group. Typical examples of anionic solubilizing groups are sulfonate, sulfate, carboxylate, phosphonate and phosphate. Examples of suitable anionic detergents which fall within the scope of the invention include the soaps, such as the water-soluble salts of higher fatty acids or rosin acids, such as may be derived from fats, oils and waxes of animal, vegetable origin, e.g. the sodium soaps of tallow, grease, coconut oil, tall oil and mixtures thereof; and the sulfated and sulfonated synthetic detergents, particularly those having about 8 to 26, and preferably about 12 to 22, carbon atoms to the molecule.

As examples of suitable synthetic anionic detergents there may be cited the higher alkyl mononuclear aromatic sulfonates such as the higher alkyl benzene sulfonates containing from 10 to 16 carbon atoms in the alkyl group in a straight or branched chain, e.g., the sodium salts of higher alkyl benzene sulfonates or of the higher alkyl toluene, xylene and phenol sulfonates; alkyl naphthalene sulfonate, ammonium diamyl naphthalene sulfonate, and sodium dinonyl naphthalene sulfonate. In one preferred type of composition there is used a linear alkyl benzene sulfonate having a high content of 3- (or higher) phenyl isomers and a correspondingly low content (well below 50%) of 2- (or lower) phenyl isomers; in other terminology, the benzene ring is preferably attached in large part at the 3 or higher (e.g. 4,5,6 or 7) position of the alkyl group and the content of isomers in which the benzene ring is attached at the 2 or 1 position is correspondingly low. Particularly preferred materials are set forth in U.S. Pat. No. 3,320,174, May 16, 1967, of J. Rubinfeld.

Other anionic detergents are the olefin sulfonates, including long chain alkene sulfonates, long chain hydroxyalkane sulfonates or mixtures of alkenesulfonates and hydroxyalkanesulfonates. These olefin sulfonate detergents may be prepared, in known manner, by the reaction of $SO_3$ with long chain olefins (of 8–25, preferably 12–21 carbon atoms) of the formula $RCH{=}CHR_1$, where R is alkyl and $R_1$ is alkyl or hydrogen, to produce a mixture of sultones and alkenesulfonic acids, which mixture is then treated to convert the sultones to sulfonates. Examples of other sulfate or sulfonate detergents are paraffin sulfonates having, for example, about 10–20, preferably about 15–20, carbon atoms such as the primary paraffin sulfonates made by reacting long chain alpha olefins and bisulfites (e.g. sodium bisulfite) or paraffin sulfonates having the sulfonate groups distributed along the paraffin chain such as the products made by reacting a long chain paraffin with sulfur dioxide and oxygen under ultraviolet light followed by neutralization with NaOH or other suitable base (as in U.S. Pat. Nos. 2,503,280; 2,507,088; 3,260,741; 3,372,188 and German patent 735,096); sulfates of higher alcohols; salts of $\alpha$-sulfofatty esters (e.g. of about 10 to 20 carbon atoms, such as methyl $\alpha$-sulfomyristate or $\alpha$-sulfotallowate).

Examples of sulfates of higher alcohols are sodium lauryl sulfate, sodium tallow alcohol sulfate, Turkey Red Oil or other sulfated oils, or sulfates of mono- or di-glycerides of fatty acids (e.g. stearic monoglyceride monosulfate), alkyl poly (ethenoxy) ether sulfates such as the sulfates of the condensation products of ethylene oxide and lauryl alcohol (usually having 1 to 5 ethonoxy groups per molecule); lauryl or other higher alkyl glyceryl ether sulfonates; aromatic poly (ethanoxy) ether sulfates such as the sulfates of the condensation products of ethylene oxide and nonyl phenol (usually having 1 to 6 oxyethylene groups per molecule.

The suitable anionic detergents include also the acyl sarcosinates (e.g. sodium lauroylsarcosinate) the acyl esters (e.g. oleic acid ester) of isethionates, and the acyl N-methyl taurides (e.g. potassium N-methyl lauroyl- or oleyl tauride).

The most highly preferred water soluble anionic detergent compounds are the ammonium and substituted ammonium (such as mono-, di- and triethanolamine), alkali metal (such as sodium and potassium) and alkaline earth metal (such as calcium and magnesium) salts of the higher alkyl benzene sulfonates, olefin sulfonates, the higher alkyl sulfates, and the higher fatty acid monoglyceride sulfates. The particular salt will be suitably selected depending upon the particular formulation and the proportions therein.

Nonionic surface active agents include those surface active or detergent compounds which contain an organic hydrophobic group and a hydrophilic group which is a reaction product of a solubilizing group such as carboxylate, hydroxyl, amido or amino with ethylene oxide or with the polyhydration product thereof, polyethylene glycol.

As examples of nonionic surface active agents which may be used there may be noted the condensation products of alkyl phenols with ethylene oxide, e.g., the reaction product of isooctyl phenol with about 6 to 30 ethylene oxide units; condensation products of alkyl thiophenols with 10 to 15 ethylene oxide units; condensation products of higher fatty alcohols such as tridecyl alcohol with ethylene oxide; ethylene oxide addends of monoesters of hexahydric alcohols and inner ethers thereof such as sorbitan monolaurate, sorbitol monooleate and mannitan monopalmitate, and the condensation products of polypropylene glycol with ethylene oxide.

A particularly suitable composition, for use as a granular detergent material contains a mixture of a linear alkylbenzenesulfonate, as previously described, soap and a nonionic detergent, with the soap and nonionic detergent being present in minor portions. The ratios of the amounts of (A) soap, and (B) nonionic detergent, to (C) the total amount of the synthetic anionic sulfate and sulfonate detergent, in this mixture are preferably as follows: A:C, about 1:10 to 1:2, preferably about 1:4 to 1:6, on an anhydrous basis; B:C about 1:10 to 1:3, e.g. about 1:4 to 1:6, on an anhydrous basis. The component (C) may comprise a blend of the linear alkylbenzenesulfonate detergent with other anionic synthetic sulfate or sulfonate detergents (e.g. olefin sulfonates, paraffin sulfonates having the sulfonate groups distributed along the paraffin chain, or alkyl sulfates) with the alkylbenzenesulfonate constituting, say, 1/3, 1/2 or 2/3 of this blend.

Examples of suitable amphoteric detergents are those containing both an anionic and a cationic group and a hydrophobic organic group, which is advantageously a higher aliphatic radical, e.g. of 10–20 carbon atoms. Among these are the N-long chain alkyl aminocarboxylic acids (e.g. of the formula $$R-\overset{R_2}{\overset{|}{N}}-R'-COOM);$$

the N-long chain alkyl iminodicarboxylic acids (e.g. of the formula $RN(R'COOM)_2$) and the N-long chain alkyl betains (e.g. of the formula $$R-\overset{+R_3}{\underset{R_4}{N}}-R'-COO^-)$$

where R is a long chain alkyl group, e.g. of about 10–20 carbons, R′ is a divalent radical joining the amino and carboxyl portions of an amino acid (e.g. an alkylene radical of 1–4 carbon atoms), M is hydrogen or a salt-forming metal, $R_2$ is a hydrogen or another monovalent substituent (e.g. methyl or other lower alkyl), and $R_3$ and $R_4$ are monovalent substituents joined to the nitrogen by carbon-to-nitrogen bonds (e.g. methyl or other lower alkyl substituents). Examples of specific amphoteric detergents are N-alkyl-beta-aminopropionic acid; N-alkyl-beta-iminodipropionic acid, and N-alkyl, N,N-dimethyl glycine; the alkyl group may be, for example, that derived from coco fatty alcohol, lauryl alcohol, myristyl alcohol (or a lauryl-myristyl mixture), hydrogenated tallow alcohol, cetyl, stearyl, or blends of such alcohols. The substituted aminopropionic and iminodipropionic acids are often supplied in the sodium or other salt forms, which may likewise be used in the practice of this invention. Examples of other amphoteric detergents are the fatty imidazolines such as those made by reacting a long chain fatty acid (e.g. of 10 to 20 carbon atoms) with diethylene triamine and monohalocarboxylic acids having 2 to 6 carbon atoms, e.g.

1-coco-5-hydroxethyl-5-carboxymethylimidazoline;

betaines containing a sulfonic group instead of the carboxylic group; betaines in which the long chain substituent is joined to the carboxylic group without an intervening nitrogen atom, e.g. inner salts of 2-trimethylamino fatty acids such as 2-trimethylaminolauric acid, and compounds of any of the previously mentioned types but in which the nitrogen atom is replaced by phosphorus.

Examples of water-soluble builder salts which may be used, particularly when heavy duty cleaning is desired, include phosphates and particularly condensed phosphates (e.g. pyrophosphates or tripolyphosphates), silicates, borates and carbonates (including bicarbonates), as well as organic builders such as salts of nitrilotriacetic acid or ethylene diamine tetracetic acid. Sodium and potassium salts are preferred. Specific examples are sodium tripolyphosphate, potassium pyrophosphate, sodium hexametaphosphate, sodium carbonate, sodium bicarbonate, sodium sesquicarbonate, sodium tetraborate, sodium silicate, salts (e.g. Na salt) of methylene diphosphonic acid, trisodium nitrilotriacetate, disodium diglycollate, or mixtures of such builders, including mixtures of pentasodium tripolyphosphate and trisodium nitrilotriacetate in a ratio, of these two builders, of 1:10 to 10:1, e.g. 1:1. The proportions of builder salt may be, for example, 50 parts or more (e.g. 50 to 1000 parts) per 100 parts of detergent.

The alkaline protease preparation and the alpha-amylase preparation may be added separately, as dry powders, to the detergent composition, or the two enzymes may be preblended before adding them. The enzymes, alone or preblended together, may be mixed with other ingredients before they are added to the detergent composition. Thus they may be mixed with a larger amount of a builder salt (such as particles of anhydrous pentasodium tripolyphosphate) and adhered to the surfaces of the builder salt particles by means of a water-soluble polyvinyl alcohol or carboxymethyl cellulose coating; in one embodiment a dry mixture of 3.7 parts of each of the two powdered enzyme preparations, and 87 parts of light density granular pentasodium tripolyphosphate (anhydrous, Form I or II) which is mainly of 20–40 mesh particle size (particle diameters 0.25 – 0.84 mm) is tumbled while 5.5 parts of a 10% aqueous solution of polyvinyl alcohol is sprayed thereon to give a non-dusty, non-caking granular product.

A dry blend of powders of the neutral protease preparation in the proportions described herein may be separately packaged and added to the wash water. The package may be a packet or capsule of the water soluble type, e.g. of polyvinyl alcohol film, and may contain enough enzyme for use in one wash (e.g. sufficient of the enzymes to provide the same concentration thereof, in 17 gallons of wash water, as if the enzyme mixture were premixed into the detergent composition, i.e. the packet may contain an amount of the enzyme blend such as to supply a total of about ¼ or ⅓ or ½ Anson unit of the alkaline protease). The packet may also contain a solid finely divided carrier or diluent (such as a builder salt or a nonionic solid detergent mixed with or coated with the enzyme preparations). On addition of the packet to the wash water the film dissolves, releasing the enzyme mixture.

It is also within the broad scope of this invention to use the enzyme mixture in a liquid detergent composition, e.g. an aqueous solution containing the enzymes and an organic detergent such as an olefin sulfonate detergent or alkylbenzenesulfonate detergent, as previously described, with or without builder salts.

The compositions often contain sodium sulfate, present in proportions of, for example, up to about 50% of the total solids.

Various other materials may be added to the detergent mixture in suitable amounts. Materials such as the higher fatty acid amides may be added to improve detergency and modify the foaming properties in a desirable manner. Examples thereof are the higher fatty acid alkanolamides, preferably having 2–3 carbons in each alkanol group and a fatty acyl radical within the range of 10–18 carbons, preferably 10–14 carbons, such as lauric or myristic monoethanolamides, diethanolamides and isopropanolamides. Tertiary higher alkyl amine oxides such as those having about 10–18 carbons in one alkyl group, e.g. lauryl or myristyl dimethylamine oxide, may be added also. Fatty alcohols of 10–18 carbons such as lauryl or coconut fatty alcohols, or cetyl alcohol are suitable additives also. A hydrotropic material such as the lower alkyl aryl sulfonates, e.g. sodium toluene or xylene sulfonates, can assist processing also. In general, these materials are added in minor amounts, usually from about ½ to 10%, preferably 1 to 6%, based on the total solids.

The mixtures may also contain optical brightening agents or fluorescent dyes (e.g. in amounts in the range of about 1/20% to ½%); germicidal ingredients such as halogenated carbanilides, e.g. trichlorocarbanilide, halogenated salicylanilide, e.g. tribromosalicylanilide, halogenated bisphenols, e.g. hexachlorophene, halogenated trifluoromethyldiphenyl urea, zinc salt of 1-hydroxy-2- pyridinethione and the like (e.g. in amounts in the range of about 1/50% to 2%); soil-suspending agents such as sodium carboxymethyl cellulose or polyvinyl alcohol, preferably both, or other soluble polymeric materials, such as methyl cellulose (the amount of suspending agent being, for example, in the range of about 1/20% to 2%); antioxidants such as 2,6-di-tert-butylphenol, or other phenolic antioxidant materials (e.g. in amounts in the range of about 0.001 to 0.1%), coloring agents, bleaching agents and other additives.

Borax, e.g. in proportion of up to about 10% (such as 1 to 15%) of the total solids may also be present.

In the assay using a casein substrate, described above, the enzyme preparation to be tested is dissolved (in a concentration on the order of 15 ppm) in an amine buffered aqueous solution having a pH of 9.0 (measured at 50°C.); this amine-buffered solution is made by mixing 1000 ml of an aqueous aminediol solution, containing 21.3 grams of 2-amino-2-methyl-1,3-propanediol in said 1000 ml, with 500 ml of 0.1N HCl solution and adding sufficient water to make 4000 ml. A casein solution is prepared at a concentration of ½% w/v in said amine-buffered solution, using heat to aid in dissolving the casein. Equal volumes (e.g. 1 ml each) of the casein solution and the enzyme solution are mixed and maintained at 50°C for the predetermined period (e.g. 15 minutes), then subjected to a temperature of 100°C (in the boiling water bath, as previously described) to stop the reaction. The digested mixture is then diluted with an equal total volume (e.g. 2 ml) of water and maintained at 50°C. A 0.3 ml aliquot of the diluted digested mixture is then further diluted with 2.5 ml of a citrate buffer solution; this buffer solution is made by mixing 20 ml of a stock citric acid solution (made by dissolving 21.02 grams of citric acid monohydrate in an amount of water sufficient to give a total volume of 500 ml) with 55 ml of a stock trisodium citrate solution (made by dissolving 29.41 grams of trisodium citrate in an amount of water sufficient to give a total volume of 500 ml) and add sufficient water to make 100 ml. Then 1.5 ml of a freshly prepared ninhydrin solution is added to the resulting buffered diluted digested mixture; the ninhydrin solution is made by mixing 2 grams ninhydrin with 4 ml of a 0.01 M solution of KCN in methyl cellosolve and diluting this solution to 300 ml with methyl cellosolve; the methyl cellosolve should be free of peroxides (e.g. it should not develop a yellow color on admixing with a potassium iodide solution). After the ninhydrin solution has been added the mixture (in a capped tube) is placed in a boiling water bath for 18 minutes, removed, and immediately placed in a cool water bath. After cooling the color intensity is measured at a wavelength of 570 mμ.

The following Example is given to illustrate this invention further. In this Example and in the remainder of the application, all proportions are by weight unless otherwise indicated.

EXAMPLE

One suitable spray-dried detergent composition has the following approximate overall composition: 10% sodium linear tridecylbenzenesulfonate; 2% of the ethoxylation product made from ethylene oxide and primary alkanols of C14–C15 chain length, the ethoxylation product containing 11 mols of oxyethylene per mol of alkanol; 2% of sodium soap of a mixture of 3 parts of tallow fatty acids and 1 part of coconut oil fatty acids; about 8.5% total moisture; 34% of phosphate solids; 7% of sodium silicate solids ($Na_2O:SiO_2$ mol ration 1:2.35); 0.15% of ultramarine blue; 0.5% of sodium carboxymethyl cellulose; 0.2% of watersoluble polyvinyl alcohol; 0.44% of fluorescent brighteners; 0.023% Polar Brilliant Blue RAW; 0.01% of a phenolic antioxident ("Iphol") and the balance sodium sulfate and a small amount of perfume.

This composition is prepared in granular form by spray drying a heated aqueous slurry containing the ingredients described and having a solids content of about 60% (i.e. the slurry has a total moisture content of about 40%). The slurry is prepared by vigorous agitation in a crutcher and is at a temperature of about 60°C; in making the slurry the phosphate (supplied as a powder of anhydrous pentasodium tripolyphosphate) is added last, just before spraying.

The slurry is sprayed into a spray tower fed, countercurrent, with heated air; the air enters at the base of the tower at a temperature in the range of about 290° or 310° to 370°C and leaves at, say, 80° to 105°C. During spray drying there are formed granules of hollow beads, some being in the form of individual beads and most being in the form of clusters of such beads.

The brighteners used in this Example include (a) a naphthotriazole stilbene sulfonate brightener (Geigy "Tinopal RBS-200%"), (b) another stilbene brightener, bis (anilino diethanolamino triazinyl) stilbene disulfonic acid (c) another stilbene brightener, sodium bis (anilino morpholino triazinyl) stilbene disulfonate, and (d) an oxazole brightener, having a 1-phenyl 2-benzoxazole ethylene structure, in the proportions of (a) 0.071%, (b) 0.071% (c) 0.21% and (d) 0.088%.

The resulting granules are blended with ¼% of their weight of very finely powdered alkaline protease preparation ("Alcalase," containing 1.5 Anson units of protease per gram, measured at pH 7.5) and ¼% of their weight of an alpha-amylase (containing 360,000 Novo units per gram together with a minor amount, about 0.4–0.5 Anson unit per gram, of neutral protease).

The resulting product is found to be highly effective in practical laundry tests in automatic washing machines, using 0.15% of the product in New Brunswick, N.J., tap water (whose hardness is about 100 ppm) at 120°F., both for all-cotton clothes and garments made of blends of polyethylene terephthalate fibers and cotton fibers (e.g. 65:35 and 35:65 fiber blends). The results are substantially as good as those obtained with an otherwise identical composition containing twice as much of the Alcalase (i.e. ½%) without the amylase preparation.

The product is tested for retention of its fabric-washing effectiveness in storage in both ordinary cardboard boxes (of the type in which built household detergent compositions are sold, conventionally, for home use) and boxes of the same type but which have walls that are highly resistant to the passage of atmospheric moisture. Tests are also carried out at elevated temperatures (e.g. 130°F.) and under humid conditions (e.g. 90°F., 90% R.H.). The composition of this Example shows good retention of its stain removal ability.

In another case, the procedure and proportions are identical, except that the assay of the alpha-amylase is 264,000 Novo units (rather than 360,000) per gram.

EXAMPLE II

Example I is repeated, using Wallerstein Amylase B6-3-7 P (having an alpha-amylase assay of 3.2 million PL units per gram) as the alpha-amylase preparation. In washing tests using cocoastained and blood-milk-ink-stained fabrics the results were as good as or better than those obtained by the use of twice as much (i.e. ½%) of the Alcalase without the amylase preparation.

EXAMPLE III

Example I is repeated, using as the granular detergent a composition containing 8.5% moisture, 10% nonionic detergent (polyethoxylated fatty alcohol) 7.0% sodium silicate solids, 29.3% tripolyphosphate as $Na_5P_3O_{10}$, 8.7% pyrophosphate as $Na_4P_2O_7$, and 1.2% orthophosphate as $Na_2HPO_4$, 3% sodium carbonate and the balance sodium sulfate plus small amounts of brighteners. To these granules there is added ¼% of each of the two enzyme preparations used in Example I.

EXAMPLE IV

Example I is repeated except that there is used, as the spray dried detergent, a composition containing about 8% of sodium tallow alcohol sulfate, about 8% of sodium linear dodecylbenzenesulfonate, about 3% coco monoethanalamide, about 1% lauryl alcohol, about 50% pentasodium tripolyphosphate, about 5% sodium silicate, about 7% water and the balance sodium sulfate plus small amounts of brighteners.

Formulations are also prepared as in Example 1 containing about 150,000, 200,000, and 300,000 Novo alpha-amylase units per Anson unit of alkaline protease, there being about 0.35 Anson unit of said alkaline protease per 100 grams of the total composition.

The mixture of enzymes described herein is found to be effective at the relatively high pH values typical of commercial heavy duty built detergent compositions, such as a pH in the range of 9 to 10.5, e.g. 9.5 – 10; these pH values are measured on an aqueous 0.15% solution of the detergent composition.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

We claim:

1. A detergent composition for the washing of fabrics which consists essentially of a mixture of a surface active synthetic organic detergent selected from the group consisting of anionic, nonionic and amphoteric detergents and a mixture of enzyme powders, which enzyme powder mixture consists essentially of about 90,000 Novo alpha-amylase units of a bacterial alpha-amylase to about ⅜ Anson unit of an alkaline protease, with the alkaline protease being present in an amount to provide one Anson unit thereof for each 100 to 500 grams of detergent composition.

2. A detergent composition according to claim 1 wherein the synthetic organic detergent contains a hydrocarbon sulfonate having 8 to 26 carbon atoms and the content of alkaline protease is about one Anson unit thereof for each 200 to 400 grams of detergent composition.

3. A composition according to claim 2 in which the hydrocarbon sulfonate is sodium linear alkyl benzene sulfonate, having 10 to 16 carbon atoms in the alkyl group thereof and in which there is present a water soluble builder salt, with the proportion thereof being 50 to 1,000 parts by weight per 100 parts by weight of synthetic organic detergent and the content of alkaline protease is about ⅜ Anson unit per 100 grams of detergent composition.

4. A composition according to claim 3 wherein the synthetic organic detergent is a mixture of about 10 parts of sodium linear tridecylbenzene sulfonate, about 2 parts of the ethoxylation product of 11 mols of ethylene oxide and a primary alkanol of 14 to 15 carbon atoms and about 2 parts of sodium soap of higher fatty acids and the builder salt is pentasodium tripolyphosphate.

5. A built synthetic organic detergent composition for use in washing fabrics which consists essentially of a mixture of an alkaline builder salt and a minor proportion of a mixture of a surface active synthetic organic detergents selected from the group consisting of anionic, nonionic and amphoteric detergents, and an enzyme powder, which enzyme powder consists essentially of a mixture of bacterial alpha-amylase and alkaline protease with the proportion thereof being about 90,000 Novo alpha-amylase units of bacterial alpha-amylase to about ⅜ Anson unit of alkaline protease, the builder salt being present in an amount corresponding to about 50 to 1,000 parts thereof by weight per 100 parts by weight of said surface active synthetic organic detergent and said alkaline protease being present in an amount to provide one Anson unit thereof for each 100 to 500 grams of detergent composition.

6. A composition according to claim 5 which has a pH, measured in 0.15% aqueous solution, of 9 to 10.5.

7. In the washing of fabrics in wash water containing a surface active synthetic organic detergent selected from the group consisting of anionic, nonionic and amphoteric detergents, and water soluble builder salt, said builder salt being present in an amount of about 50 to 1,000 parts by weight per 100 parts by weight of said synthetic organic detergent, the improvement which comprises including in the wash water a mixture of enzymes, which mixture consists essentially of bacterial alpha-amylase and alkaline protease with the proportion thereof being about 90,000 Novo alpha-amylase units of the bacterial alpha-amylase to about ⅜ Anson unit of alkaline protease and with the amounts of such enzymes being such as to provide one Anson unit of the alkaline protease for each 100 to 500 grams of detergent composition.

* * * * *